US011236880B1

(12) United States Patent
Chung

(10) Patent No.: US 11,236,880 B1
(45) Date of Patent: Feb. 1, 2022

(54) THREE-DIMENSIONAL IMAGE LIGHTING APPARATUS

(71) Applicant: HYUNDAI MOBIS CO., LTD., Seoul (KR)

(72) Inventor: Yong Woon Chung, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 17/136,203

(22) Filed: Dec. 29, 2020

(30) Foreign Application Priority Data

Nov. 6, 2020 (KR) ..... 10-2020-0147470

(51) Int. Cl.
*F21S 41/33* (2018.01)
*F21S 41/50* (2018.01)
*F21S 41/25* (2018.01)
*F21S 41/24* (2018.01)

(52) U.S. Cl.
CPC ..... *F21S 41/337* (2018.01); *F21S 41/24* (2018.01); *F21S 41/25* (2018.01); *F21S 41/50* (2018.01)

(58) Field of Classification Search
CPC ..... G03H 223/24; F21S 41/337; F21S 41/24; F21S 41/25; F21S 41/50
See application file for complete search history.

(56) References Cited

U.S. PATENT DOCUMENTS

| | | | | |
|---|---|---|---|---|
| 8,475,020 | B2 * | 7/2013 | Dubosc | F21S 43/30 362/517 |
| 8,985,814 | B2 * | 3/2015 | King | F21V 14/06 362/286 |
| 9,121,564 | B2 * | 9/2015 | Buisson | F21V 7/0025 |
| 9,776,555 | B2 * | 10/2017 | Fukai | B60Q 1/26 |
| 2013/0010487 | A1 | 1/2013 | Buisson | |
| 2014/0029106 | A1 * | 1/2014 | Shih | F21S 43/40 359/633 |
| 2015/0062946 | A1 | 3/2015 | Fukai et al. | |

FOREIGN PATENT DOCUMENTS

| | | | |
|---|---|---|---|
| CN | 111336463 A | * | 6/2020 |
| DE | 10 2010 021 939 | | 12/2011 |
| KR | 10-2013-0018782 | | 2/2013 |

* cited by examiner

*Primary Examiner* — Matthew J. Peerce
(74) *Attorney, Agent, or Firm* — H.C. Park & Associates, PLC

(57) ABSTRACT

A three-dimensional image lighting apparatus includes one or more light guides configured to guide paths of lights incident from one or more light sources toward a light distribution space, and to emit the lights, one or more divergence lenses disposed on the light distribution space so as to extend along the light guides, and configured to diverge the lights, which are incident from the light guides, in a linear shape, a half mirror disposed on one side of the divergence lenses, and a mirror disposed on the other side of the divergence lenses so as to face the divergence lenses, and configured to reflect the lights, which are diverged by the divergence lenses, between the half mirror and the mirror.

19 Claims, 7 Drawing Sheets

THREE-DIMENSIONAL IMAGE LIGHTING APPARATUS

CROSS-REFERENCE TO RELATED APPLICATION

This application claims priority from and the benefit of Korean Patent Application No. 10-2020-0147470, filed on Nov. 6, 2020, which is hereby incorporated by reference for all purposes as if set forth herein.

BACKGROUND

Field

Exemplary embodiments of the present disclosure relate to a three-dimensional image lighting apparatus, and more particularly, to a three-dimensional image lighting apparatus that expresses a sense of depth by reflection of light.

Discussion of the Background

In general, various vehicle lamps have been applied to allow a driver to easily check objects around a vehicle or inform other vehicles or other road users of the travel state of the vehicle when the vehicle is traveling.

For example, there are lighting devices that operate in a manner of directly emitting light using lamps, such as a headlight that emits light forward in order to secure a driver's vision, a brake light that is turned on/off when a brake is stepped, and a turn indicator used when a driver turns right or left. In addition, a reflector, and the like have been applied, which operates in a manner of reflecting light in order for pedestrians, other vehicles and the like to easily recognize a vehicle.

Such a vehicle lamp is a main design factor for determining the design of a vehicle while securing visibility, and there have been continuous effects to provide more diverse images in order to secure design differentiation from other vehicle types and aesthetics.

The background art of the present disclosure is disclosed in Korean Patent Application Laid-Open No. 2013-0018782 (published on Feb. 25, 2013 and entitled "Device for Producing Infinity Effect for Motor Vehicle Signaling Light").

The above information disclosed in this Background section is only for enhancement of understanding of the background of the invention and, therefore, it may contain information that does not constitute prior art.

SUMMARY

Embodiments of the present invention provide a three-dimensional image lighting apparatus capable of further improving the degree of freedom of design while implementing design differentiation from existing vehicle lamps.

In an embodiment, a three-dimensional image lighting apparatus includes: one or more light guides configured to guide paths of lights incident from one or more light sources toward a light distribution space, and to emit the lights; one or more divergence lenses disposed on the light distribution space so as to extend along the light guides, and configured to diverge the lights, which are incident from the light guides, in a linear shape; a half mirror disposed on one side of the divergence lenses; and a mirror disposed on the other side of the divergence lenses so as to face the divergence lenses, and configured to reflect the lights, which are diverged by the divergence lenses, between the half mirror and the mirror.

The divergence lenses may each have a linear rod shape and be disposed while being spaced apart from one another along a circumference of the light distribution space, and the light guides may each have a linear rod shape and are disposed to correspond to the divergence lenses, respectively.

The light guide may include: a light guide body; a first incident part formed on one end of the light guide body in an extension direction thereof and into which the light emitted from the light source is incident; an inward emission part formed on one side of a circumferential portion of the light guide body, the one side facing the divergence lens, and configured to emit the light to an outside of the light guide body; and a total reflection part formed on the other side of the circumferential portion of the light guide body, the other side being toward an outside of the light distribution space, and configured to totally reflect the light toward the inward emission part.

The divergence lens may include: a divergence lens body; and a light diffusion incident part which is formed on one side of a circumferential portion of the divergence lens body, the one side facing the light guide, into which the light emitted from the light guide is incident, and which has an uneven shape capable of diffusing the incident light.

The divergence lens may include: a divergence lens body; and a first light condensing and diverging part formed on the other side of a circumferential portion of the divergence lens body, the other side being in contact with the light distribution space and having a surface shape capable of inducing condensation of the light emitted to an outside of the divergence lens body.

The three-dimensional image lighting apparatus may further include one or more light quantity reinforcing lenses disposed at a central part of the light distribution space so as to be spaced apart from the divergence lenses, and configured to diverge the lights incident from the light sources toward the light distribution space.

The light quantity reinforcing lens may include: a light quantity reinforcing lens body; a second incident part formed on one end of the light quantity reinforcing lens body in an extension direction thereof and into which the lights emitted from the light sources are incident; and a second light condensing and diverging part formed on a circumferential portion of the light quantity reinforcing lens body and having a surface shape capable of inducing condensation of the light emitted to an outside of the light quantity reinforcing lens body.

The half mirror may include: a half mirror body including a light transmitting material and configured to cover one end of the light distribution space; a transflective reflection part including a material capable of reflecting light, formed on one surface of the half mirror body, and configured form a half reflection surface that allows some of the lights to pass therethrough and reflects the rest of the lights to the mirror; and one or more spot prevention grooves formed at an edge of the half mirror body, and into which some or all of circumferential portions of the divergence lenses, which face the light distribution space, are fitted and covered.

The divergence lens may include: a divergence lens body; half mirror assembly parts formed on one end of the divergence lens body in an extension direction thereof and fitted into the spot prevention grooves by passing through the half reflection surface; and mirror assembly parts formed on the other end of the divergence lens body in an extension direction thereof and assembled to the mirror.

The spot prevention groove may be formed at an edge of the half mirror body so as to be concave toward a central part of the half mirror body, and one end of the divergence lens may be fitted into the spot prevention groove by passing through the half reflection surface.

The half mirror may further include one or more contrast grooves formed to be concave among the spot prevention grooves toward a central part of the half mirror body and into which non-light transmitting materials, in which light diverged from the divergence lens and contrast are distinguished, are fitted.

The three-dimensional image lighting apparatus may further include a bezel including a non-light transmitting material and configured to form the light distribution space while receiving the light guides, the divergence lenses, the half mirror, and the mirror.

The bezel may include: a light source installation part in which the light sources are installed; a lens installation part connected to the light source installation part and having an inner surface on which the light guides and the divergence lenses are disposed, the inner surface being in contact with the light distribution space; and a design cover part connected to the lens installation part and configured to cover ends of the light guides and the divergence lenses being in contact with the half mirror.

The light source installation part may include: a first bezel body; and one or more light transmitting hole portions formed to pass through the first bezel body, and configured to form a space capable of receiving the light sources or paths through which the lights emitted from the light sources are able to pass, and having the ends of the light guides disposed therein.

The lens installation part may include: a second bezel body; and one or more cover grooves recessed into an inner surface of the second bezel body, the inner surface being in contact with the light distribution space, configured to receive the light guides therein, and having some of the divergence lenses disposed therein.

The lens installation part may further include one or more contrast protruding portions protruding among the cover grooves, alternately disposed with the divergence lenses, and configured to implement a contrast effect by a difference in brightness with the lights diverged from the divergence lenses.

The design cover part may include: a third bezel body having a ring shape of covering one end of the light guides in an extension direction thereof; and one or more divergence lens cover portions protruding from an inner surface of the third bezel body and configured to cover one end of the divergence lenses in an extension direction thereof.

The lens installation part may include: a second bezel body; one or more cover grooves recessed into an inner surface of the second bezel body, the inner surface being in contact with the light distribution space, configured to receive the light guides therein, and having some of the divergence lenses disposed therein; and one or more contrast protruding portions protruding among the cover grooves, alternately disposed with the divergence lenses, and configured to implement a contrast effect by a difference in brightness from the lights diverged from the divergence lenses, wherein the design cover part further includes: one or more protruding bezel cover portions alternately disposed with the divergence lens cover portions along an inner surface of the third bezel body and configured to cover one end of the contrast protruding portions in an extension direction thereof.

The three-dimensional image lighting apparatus in accordance with at least one embodiment can implement a linear lighting image extending in the front and rear direction by using the light guides and the divergence lenses, and express the image in a seamless linear shape in which the width and light intensity thereof gradually and continuously decrease toward the rear by infinite reflection between the half mirror and the mirror.

Consequently, in accordance with at least one embodiment, it is possible to express a three-dimensional lighting image having an infinite sense of depth in the front and rear direction by the optical action as described above, and when the plurality of divergence lenses are disposed along the circumference of the light distribution space, it is possible to implement a tunnel-shaped lighting image surrounded by a plurality of light emission lines, thereby more dramatically expressing a sense of depth in the front and rear direction.

Furthermore, in accordance with at least one embodiment, as a linear lighting image continuously extending in the front and rear direction is implemented, it is possible to implement a new lamp design clearly differentiated from an existing infinite reflection lighting image expressed in shape in which spot or ring-shaped lights are infinitely stacked while being spaced apart from one another in the front and rear direction.

Furthermore, in accordance with at least one embodiment, a three-dimensional lighting image having an infinite sense of depth longer than an actual size can be implemented as a vehicle lamp design. Thus, when the three-dimensional lighting image is applied to a component such as a headlamp and a rear lamp of a vehicle, it is possible to further improve the degree of freedom of the vehicle lamp design.

Furthermore, the embodiments described herein have a simple structure including the light guides, the divergence lenses, the half mirror, and the mirror. Thus, when the three-dimensional image lighting apparatus according to one or more embodiments is applied to a component such as a headlamp and a rear lamp of a vehicle, it is possible to further reduce the number of parts as compared with an existing infinite reflection type vehicle lamp, thereby further facilitating the manufacture, management, and assembly of vehicle lamp components.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
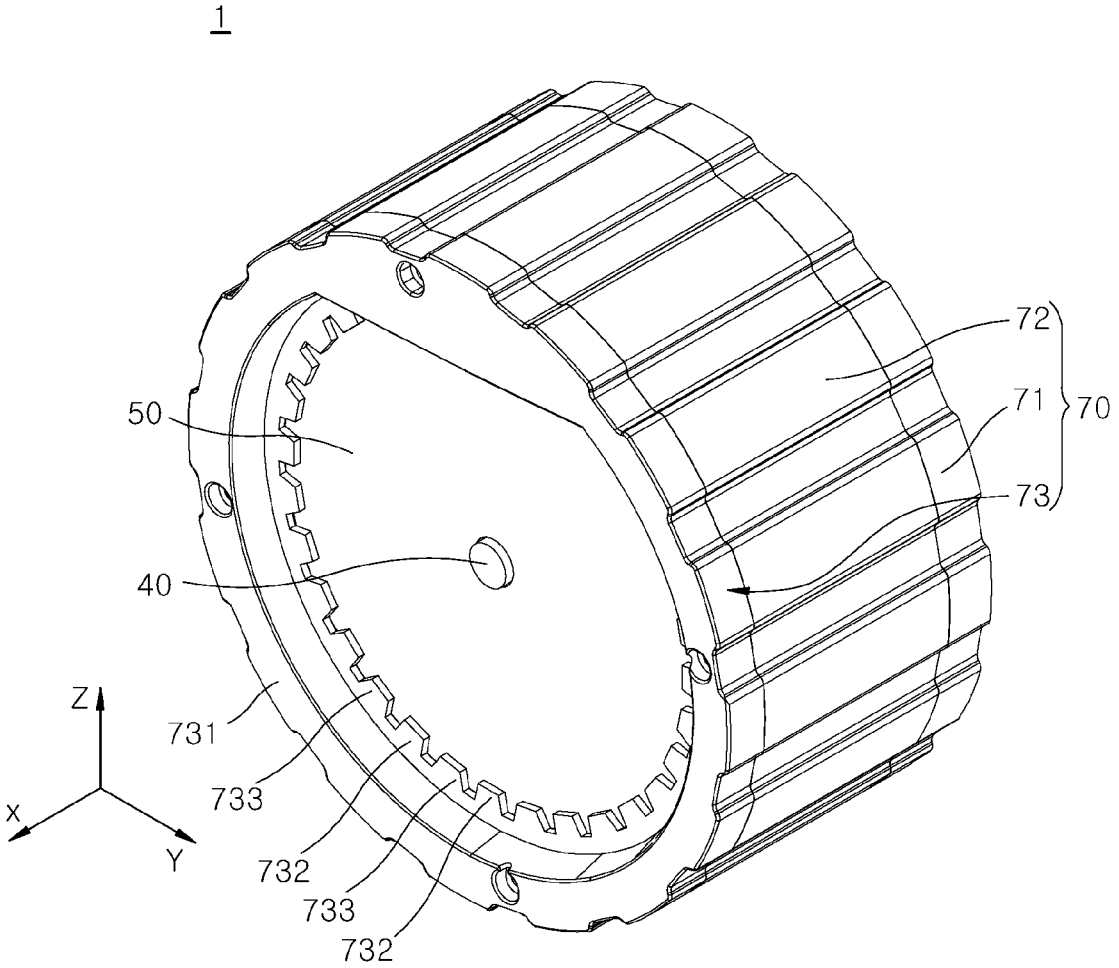
FIG. 1 is a perspective view schematically illustrating a three-dimensional image lighting apparatus in accordance with an embodiment.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Hereinafter, an embodiment of a three-dimensional image lighting apparatus will be described below with reference to the accompanying drawings. In this process, the thicknesses of lines or the sizes of components illustrated in the drawings may be exaggerated for the purpose of clarity and convenience of explanation. Terms to be described later are terms defined in consideration of functions thereof and may be changed according to the intention of a user or an operator, or practice. Accordingly, such terms should be defined based on the disclosure over the present specification.

FIG. 1 is a perspective view schematically illustrating a three-dimensional image lighting apparatus 1 in accordance with an embodiment.

Referring to FIG. 1, the three-dimensional image lighting apparatus 1 in accordance with an embodiment uses a half mirror 50 so as to distribute some of lights in an x direction (forward when applied to a headlamp body and rearward when applied to a rear lamp) and to infinitely reflect the rest of the lights in the −x direction, thereby implementing a three-dimensional lighting image having a shape in which a plurality of light emission lines continuously extending in the x direction are aligned in a set direction (circumferential direction of an x axis of FIG. 1).

Each of the light emission lines is expressed in a continuous linear shape in which its width is narrowed toward the −x direction when viewed by the naked eye, and simultaneously its light intensity gradually decreases according to the characteristics of the lighting image implemented by infinite reflection, and the three-dimensional image lighting apparatus 1 in accordance with the present disclosure can express an infinite sense of depth in the x direction by such an action.

When the three-dimensional image lighting apparatus 1 in accordance with an embodiment is applied to a component such as a headlamp (not illustrated) and a rear lamp (not illustrated) of a vehicle (not illustrated), a three-dimensional lighting image having an infinite sense of depth longer than the actual size can be implemented as a vehicle lamp design. As described above, the three-dimensional lighting image, in which the linear light emission lines having an extended length in the x direction are arranged in a direction different from the x direction, is clearly differentiated from an existing infinite reflection lighting image in which point or ring-shaped lights are expressed in an infinitely stacked shape while being spaced apart from one another in the x direction.

Figure 2:
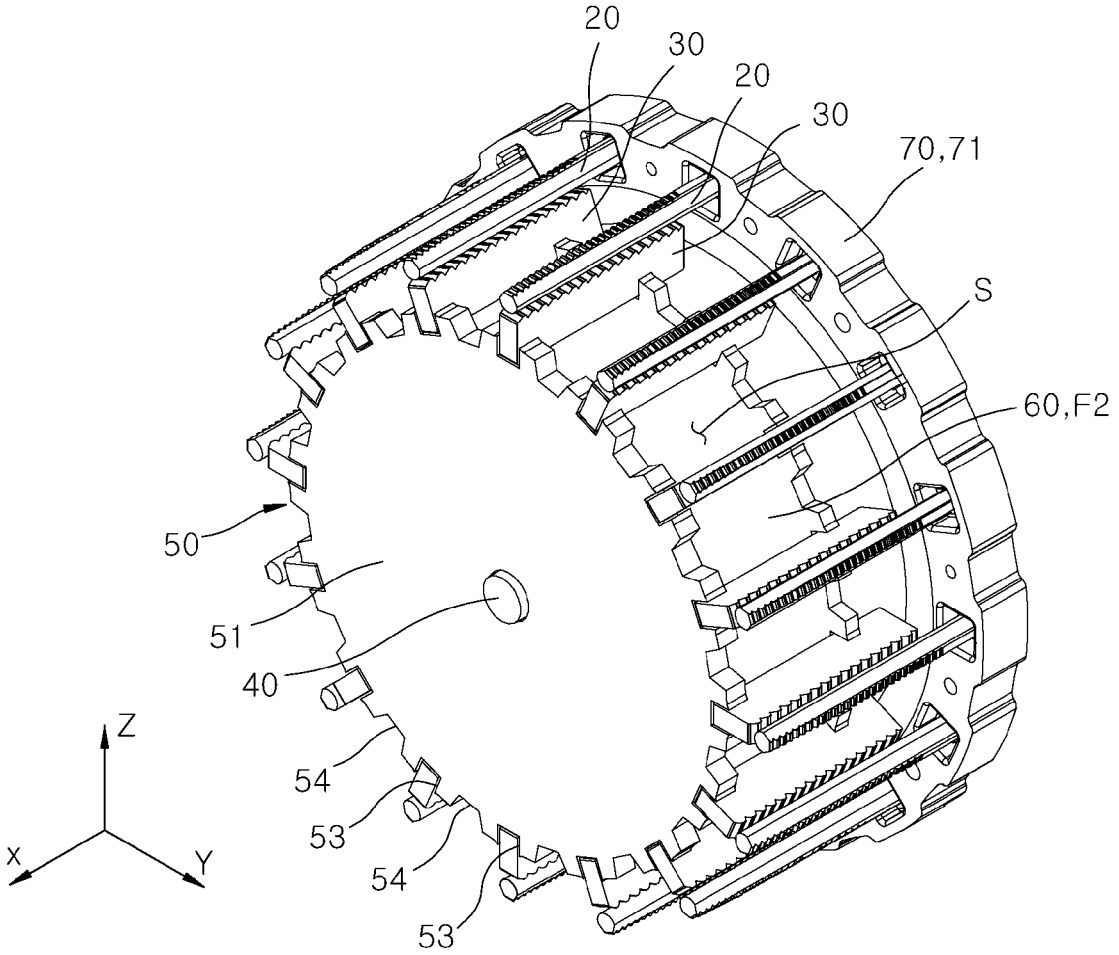
FIG. 2 is a perspective view of a main part illustrating a state in which a part of a bezel of the three-dimensional image lighting apparatus in accordance with an embodiment is separated.
Figure 3:
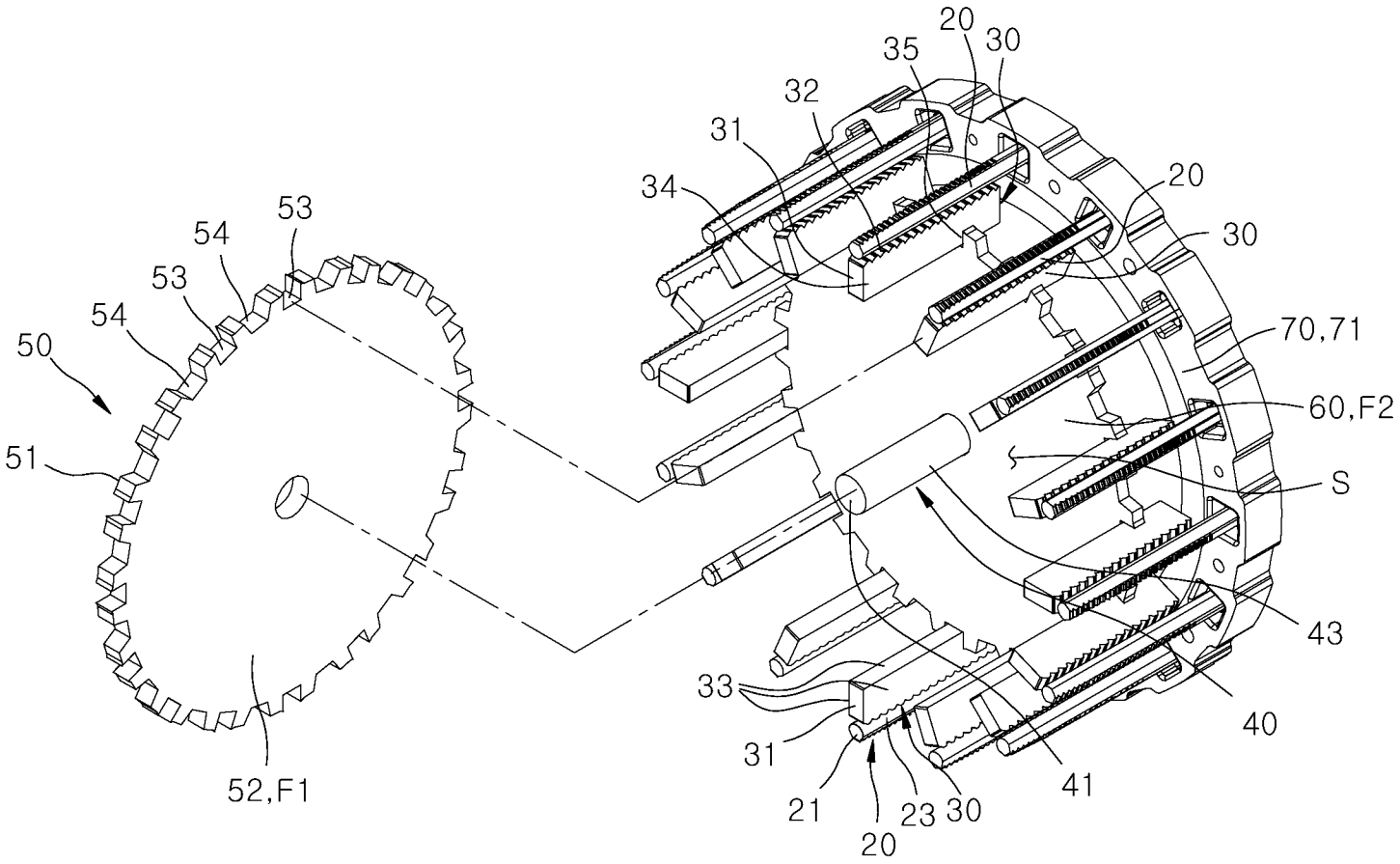
FIG. 3 is a perspective view illustrating a state in which a half-mirror is separated from FIG. 2.
Figure 4:
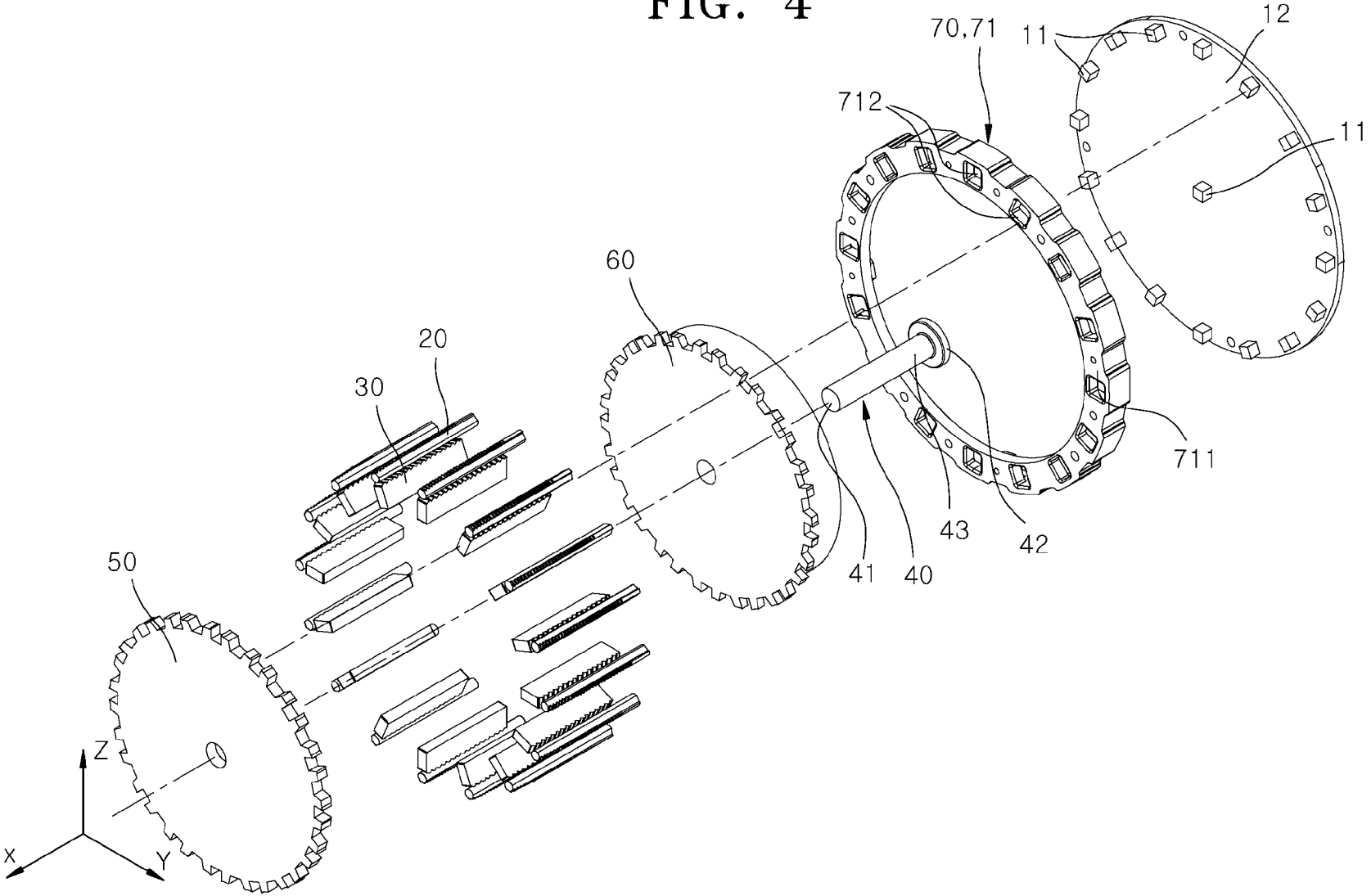
FIG. 4 is an exploded perspective view of a main part of FIG. 2.

FIG. 2 is a perspective view of a main part illustrating a state in which a part of a bezel of the three-dimensional image lighting apparatus 1 in accordance with an embodiment is separated, FIG. 3 is a perspective view illustrating a state in which a half-mirror is separated from FIG. 2, and FIG. 4 is an exploded perspective view of a main part of FIG. 2.

In the following description of the three-dimensional image lighting apparatus 1 in accordance with an embodiment, the x direction is set to the front, the −x direction is set to the rear, a z direction is set to the top, and a y direction is set to the side for convenience of description.

Referring to FIG. 2 to FIG. 4, the three-dimensional image lighting apparatus 1 in accordance with an embodiment includes light guides 20, divergence lenses 30, a light quantity reinforcing lens 40, the half mirror 50, a mirror 60, and a bezel 70.

The light guide 20 guides the path of light incident from a light source 11 toward a light distribution space S by total reflection, and emits the light. The light emitted from the light source 11 has a main optical path through which it is incident inside the light guide 20 through a rear end (end in the −x direction) of the light guide 20, and travels toward a front end (end in the x direction) of the light guide 20 along the extension direction of the light guide 20 by an optical action such as total reflection.

The light distribution space S is an empty space where the light is finally diverged by the divergence lenses 30 and the light quantity reinforcing lens 40, and is formed inside the bezel 70. The light diverged on the light distribution space S is distributed to the front of the bezel 70 through the half mirror 50. According to the three-dimensional image lighting apparatus 1 in accordance with an embodiment, various three-dimensional lighting images can be implemented according to the shape of the light distribution space S, the shapes and arrangements of the light guides 20 and the divergence lenses 30, and the shape and position of the light quantity reinforcing lens 40.

In accordance with an embodiment, the light distribution space S has a cylindrical shape with the x direction an axis, the light guides 20 and the divergence lenses 30 are arranged in the circumferential direction along the circumference of the light distribution space S, and the light quantity reinforcing lens 40 is disposed at the central part of the light distribution space S so as to extend in the x direction.

Hereinafter, for convenience of description the arrangement and shape of the components of an embodiment will be described on the assumption that the x axis is disposed based on the central part of the light distribution space S having a cylindrical shape extending in the x direction, that is, is disposed in the central part of the light distribution space S. Based on the x axis disposed in the central part of the light distribution space S, a direction toward the central part of the light distribution space S is referred to as an x-axis center direction and an opposite direction thereof is referred to as an x-axis radial direction. Furthermore, based on the x axis disposed in the central part of the light distribution space S, an x-axis circumferential direction and a tangential direction will be expressed.

The divergence lenses 30 each have a linear rod shape extending in the front and rear direction and are disposed to correspond to the light guides 20, respectively. That is, the divergence lenses 30 are disposed to be spaced apart from one another at set intervals along the circumference of the light distribution space S, like the light guides 20. The divergence lenses 30 are disposed on the light distribution space S and are disposed inward from the light guides 20 (in the x-axis center direction and the direction opposite to the x-axis radial direction).

The light emitted from the light guides 20 is incident onto the divergence lenses 30 and is diverged toward the light distribution space S by passing through the divergence lenses 30. The light diverged outside the divergence lenses 30 is expressed as a linear image formed by inner ends of the divergence lenses 30, which are exposed to the light distribution space S.

The light guides 20 in accordance with an embodiment each have a linear rod shape extending in the front and rear direction and are disposed to be spaced apart from one another at set intervals along the circumference of the light distribution space S. The divergence lenses 30 each have the linear rod shape and are disposed to correspond to the light guides 20, respectively.

Accordingly, the light distribution space S has a structure surrounded by the divergence lenses 30, and when the three-dimensional image lighting apparatus 1 is turned on, a tunnel-shaped lighting image surrounded by a plurality of light emission lines is expressed on the light distribution space S. In this way, a sense of depth in the front and rear direction can be expressed by the tunnel-shaped lighting image extending in the front and rear direction.

Furthermore, when infinite reflection by the half mirror 50 and the mirror 60 is additionally applied to the tunnel-shaped lighting image described above, the sense of depth in the front and rear direction can be expressed more dramatically. As an example, when the three-dimensional image lighting apparatus 1 in accordance with an embodiment is applied to the headlamp and the read lamp of a vehicle, it is possible to express a tunnel-shaped lighting image continuously extending through a vehicle body from the headlamp to the read lamp.

The light quantity reinforcing lens 40 is disposed at the central part of the light distribution space S so as to be spaced apart from the divergence lenses 30, and diverges the light incident from the light source 11 toward the light distribution space S. The divergence lenses 30 perform a main function of implementing a three-dimensional lighting image, and the light quantity reinforcing lens 40 performs a main function of reinforcing a light quantity so that the light quantity satisfies the regulations regarding the brightness of light when an embodiment is applied to the headlamp and the read lamp of a vehicle.

The light quantity reinforcing lens 40 may be disposed at the central part of the light distribution space S, thereby efficiently increasing the illuminance by the light diverged from the entire circumference of the light distribution space S. Furthermore, the light quantity reinforcing lens 40 may be disposed to be spaced apart from the divergence lenses 30, thereby implementing design aesthetics in harmony with the divergence lenses 30 without disturbing a three-dimensional lighting image to be implemented by the divergence lenses 30.

The half mirror 50 is disposed in front of the light distribution space S, and allows a part of the light diverged from the divergence lenses 30 to be reflected rearward and the other part of the light to pass therethrough forward. The mirror 60 is disposed at the rear of the light distribution space S so as to face the half mirror 50, and infinitely reflects the light diverged from the divergence lenses 30, between the half mirror 50 and the mirror 60.

The half mirror 50 is provided on the rear surface thereof with a half reflection surface F1 that allows a part of the light to be reflected rearward and the other part of the light to pass therethrough forward. The mirror 60 is provided on the front surface thereof with a mirror reflection surface F2 that reflects the light forward. Since the mirror 60 corresponds to the half mirror 50 or has substantially the same structure as or similar structure to the half mirror 50, except that the mirror reflection surface F2 is formed, the half mirror 50 will be representatively described in detail below.

The bezel 70 includes a non-transmitting material, and forms the light distribution space S while receiving the light guides 20, the divergence lenses 30, the half mirror 50, and the mirror 60. The light guides 20, the divergence lenses 30, the half mirror 50, and the mirror 60 may be supported by the bezel 70 and may be stably disposed at setting positions corresponding to the circumferential, front, and rear portions of the light distribution space S.

Figure 5:
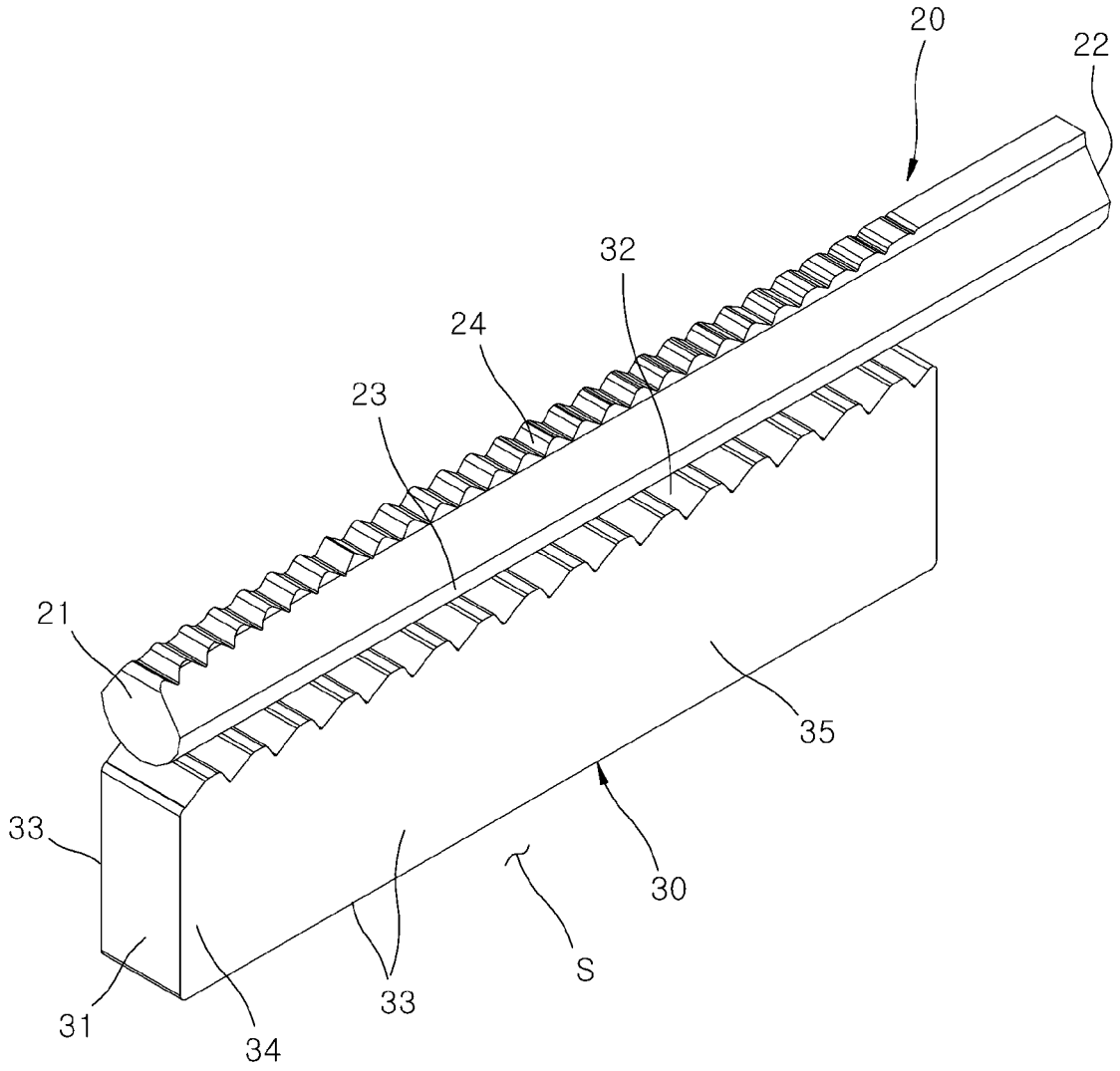
FIG. 5 is a perspective view illustrating a light guide and a divergence lens of the three-dimensional image lighting apparatus in accordance with an embodiment.
Figure 6:
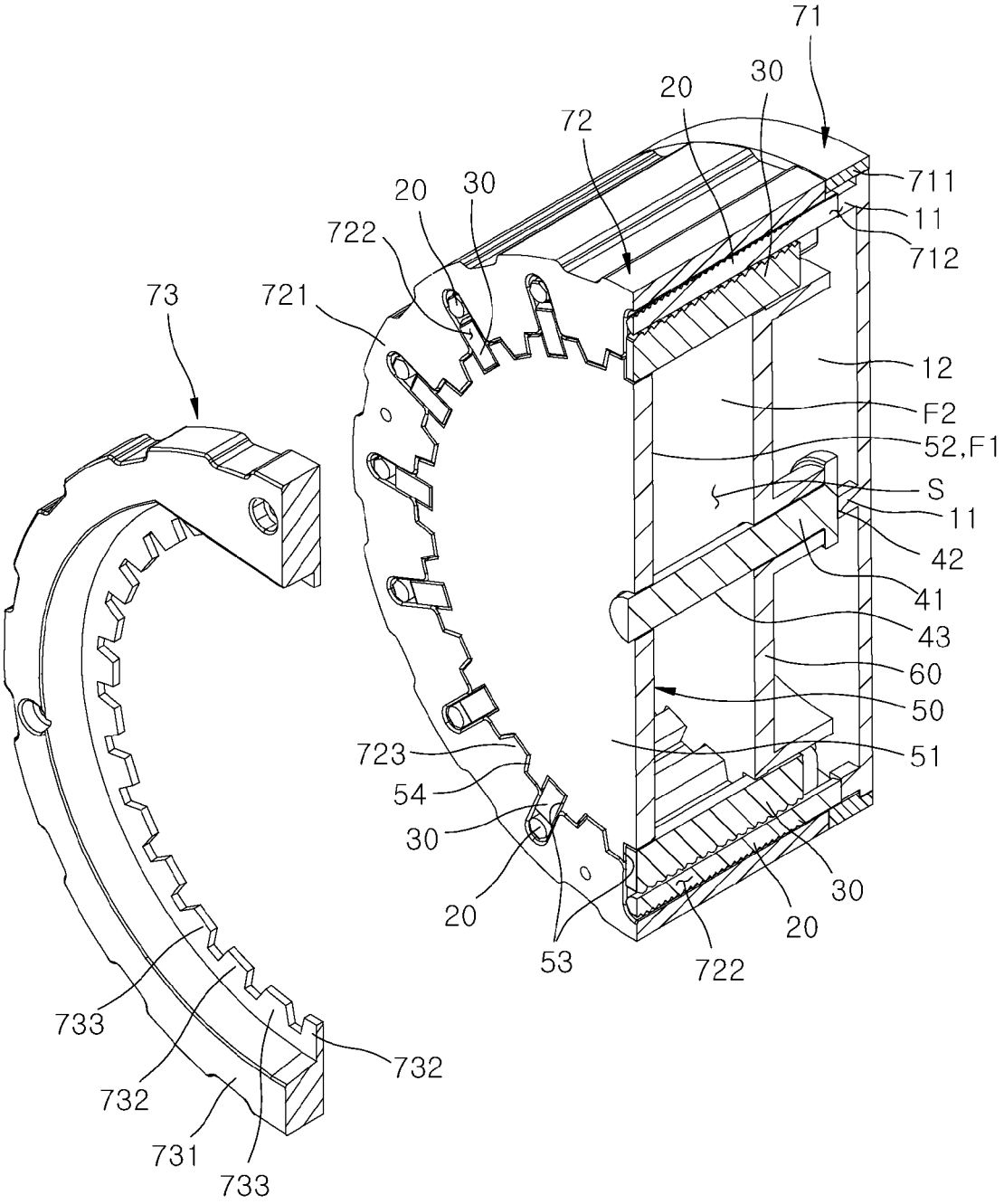
FIG. 6 is a sectional perspective view of the main part of FIG. 1.
Figure 7:
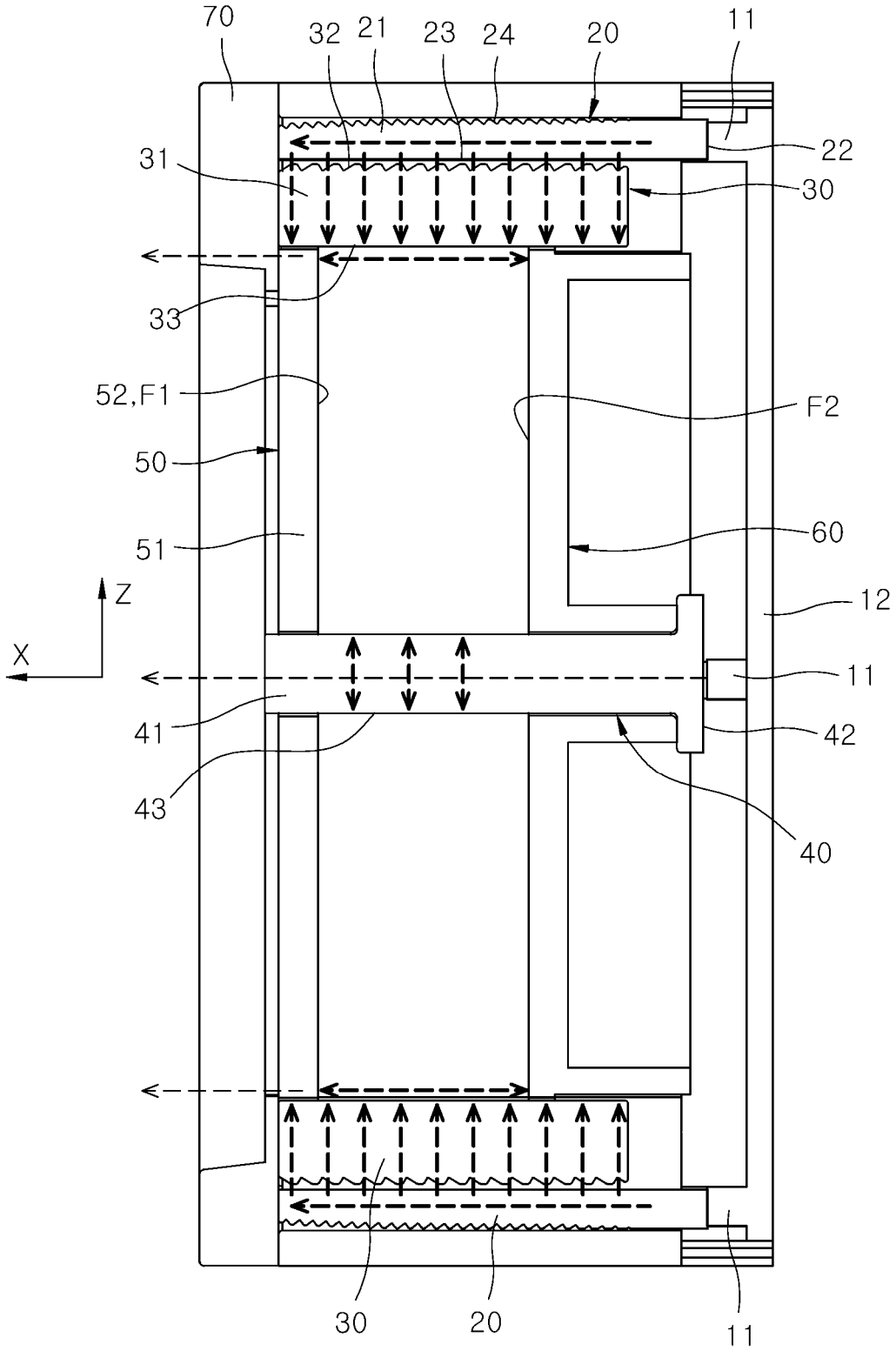
FIG. 7 is a conceptual diagram for explaining an optical path formed by the three-dimensional image lighting apparatus in accordance with an embodiment.

FIG. 5 is a perspective view illustrating the light guide and the divergence lens of the three-dimensional image lighting apparatus in accordance with an embodiment, FIG. 6 is a sectional perspective view of the main part of FIG. 1, and FIG. 7 is a conceptual diagram for explaining an optical path formed by the three-dimensional image lighting apparatus in accordance with an embodiment.

Referring to FIG. 3, FIG. 5, and FIG. 7, the light guide 20 in accordance with an embodiment includes a light guide body 21, a first incident part 22, an inward emission part 23, and a total reflection part 24.

The light guide body 21 is a part that forms the basic frame of the light guide 20, includes a light transmitting material, has a straight rod shape, and is disposed to extend in the front and rear direction. The light guide body 21 has a circular sectional shape or a fan-shaped sectional shape, in which an arc portion is directed to the divergence lens 30, as a whole so as to efficiently guide the light to the divergence lens 30 side in a state in which the circumferential portion of the light guide body 21 is covered by a divergence lens cover portion 732 of the bezel 70.

The first incident part 22 is formed at the rear end of the light guide body 21. The light emitted from the light source 11 disposed at the rear is incident into the light guide body 21 through first incident part 22. The light incident into the light guide body 21 travels forward and is diverged in the circumferential direction.

The inward emission part 23 is formed on one side of the circumferential portion of the light guide body 21, the one side facing the divergence lens 30. The total reflection part 24 is formed on the other side of the circumferential portion of the light guide body 21, the other side being toward the outside of the light distribution space S. The total reflection part 24 has an uneven shape capable of totally reflecting the light toward the inward emission part 23.

More specifically, the total reflection part 24 is formed at a part of the circumferential portion of the light guide body 21, the part facing the inward emission part 23, so as to extend in the front and rear direction, and has an uneven shape in which protruding portions protruding in the x axis radial direction and concave portions concave in the x axis center direction are alternately disposed in the front and rear direction.

Among the lights traveling in the circumferential direction of the light guide body 21, the light directed toward the inward emission part 23 is continuously incident onto the divergence lens 30 by passing through the inward emission part 23. Among the lights traveling in the circumferential direction of the light guide body 21, the light directed toward the total reflection part 24 is totally reflected by the total reflection part 24 toward the inward emission part 23, and then is continuously incident onto the divergence lens 30 by passing through the inward emission part 23.

Referring to FIG. 3, FIG. 5, and FIG. 7, the divergence lens 30 in accordance with an embodiment includes a divergence lens body 31, a light diffusion incident part 32, a first light condensing and diverging part 33, a half mirror assembly part 34, and a mirror assembly part 35.

The divergence lens body 31 is a part that forms the basic frame of the divergence lens 30, includes a light transmitting material, has a straight rod shape, and is disposed to extend in the front and rear direction. The divergence lens body 31 has a rectangular sectional shape, whose length in the x axis radial direction is longer than that in the x axis tangential direction as a whole, so that the light incident from the light guide 20 has a main directionality toward the x axis center direction.

The light diffusion incident part 32 is formed on one side of the circumferential portion of the divergence lens body 31, the one side facing the light guide 20. The first light condensing and diverging part 33 is formed on the other side of the circumferential portion of the divergence lens body 31, the other side being in contact with the light distribution space S. When viewed from the front, the light diffusion incident part 32 has a '-'-shaped sectional shape and the first light condensing and diverging part 33 has a 'C'-shaped sectional shape facing the light diffusion incident part 32. The light emitted from the light guide 20 is incident into the divergence lens body 31 through the light diffusion incident part 32 and is emitted to the outside of the divergence lens body 31 through the first light condensing and diverging part 33.

The light diffusion incident part 32 has an uneven shape capable of diffusing and diverging the incident light incident into the divergence lens body 31 from the light guide 20. More specifically, the light diffusion incident part 32 is formed at a part of the circumferential portion of the divergence lens body 31, the part facing the light guide 20, so as to extend in the front and rear direction, and has an uneven shape in which protruding portions protruding in the x axis radial direction and concave portions concave in the x axis center direction are alternately disposed in the front and rear direction.

Due to the total reflection part 24 of the light guide 20 which has the uneven shape in which the protruding portions and the concave portions are alternately disposed, there is concern that the light incident into the light diffusion incident part 32 may have a shape in which a part with a relatively large amount of incidence and a part with a relatively small amount of incidence are alternately disposed, that is, a shape in which the amount of emission directed toward the divergence lens 30 is not uniform as a whole.

By forming the light diffusion incident part 32, the incident light incident into the divergence lens body 31 can be uniformly dispersed over the entire divergence lens body 31. Accordingly, a continuous linear image with uniform light intensity can be stably implemented through the first light condensing and diverging part 33 over the entire length thereof.

The first light condensing and diverging part 33 has a surface shape capable of inducing condensation of the light emitted to the outside of the divergence lens body 31, that is, a surface roughness. This is distinguished from another part of the divergence lens 30, which has a smooth surface. The surface roughness of the first light condensing and diverging part 33 corresponds to the concept of a surface roughness for generally inducing diffused reflection. When the first light condensing and diverging part 33 is formed, a desired surface roughness may be imparted thereto by a chemical process such as etching, sandpaper treatment, machine processing such as laser etching, application of the shape of an injection mold, and the like.

The light emitted to the outside of the divergence lens body 31 is not simply diffused into the light distribution space S and does not go straight, but is condensed on the circumference of the divergence lens body 31 by the first light condensing and diverging part 33. Accordingly, it is possible to clearly implement a linear lighting image corresponding to the first light condensing and diverging part 33.

The half mirror assembly part 34 is a part of the divergence lens body 31, which is fitted and assembled into the half mirror 50, is formed at the front end of the divergence lens body 31, and is fitted into a spot prevention groove 53 by passing through the half reflection surface F1 forward. The mirror assembly part 35 is a part of the divergence lens body 31, which is fitted and assembled into the mirror 60, is formed at the other end of the divergence lens body 31 in an extension direction thereof, and is fitted and assembled into the spot prevention groove 53 by passing through the mirror reflection surface F2 rearward.

Referring to FIG. 4, FIG. 6, and FIG. 7, the light quantity reinforcing lens 40 in accordance with an embodiment includes a light quantity reinforcing lens body 41, a second incident part 42, and a second light condensing and diverging part 43.

The light quantity reinforcing lens body 41 is a part that forms the basic frame of the light quantity reinforcing lens 40, includes a light transmitting material, has a straight rod shape, and is disposed to extend in the front and rear direction. The light quantity reinforcing lens body 41 has a circular sectional shape as a whole so as to have a directionality in which the light incident from the rear light source 11 is emitted in the x axis radial direction, that is, radially, while travelling forward.

The front end of the light quantity reinforcing lens body 41 is disposed to pass through the central part of the half mirror 50 and the rear end of the light quantity reinforcing lens body 41 is disposed to pass through the central part of the mirror 60. With such an assembly structure, the light quantity reinforcing lens body 41 may be stably disposed at positions corresponding to the central parts of the half mirror 50 and the mirror 60, that is, the central part of the light distribution space S.

The second incident part 42 is formed at the rear end of the light quantity reinforcing lens body 41. The light emitted from the light source 11 disposed at the rear is incident into the light quantity reinforcing lens body 41 through the second incident part 42. The light incident into the light quantity reinforcing lens body 41 is diverged in the circumferential direction thereof, while travelling forward.

The second light condensing and diverging part 43 is formed on the entire circumference of the light quantity reinforcing lens body 41, and has a surface shape capable of inducing condensation of the light emitted to the outside of the light quantity reinforcing lens body 41, that is, a surface roughness. This is distinguished from another part of the light quantity reinforcing lens 40, which has a smooth surface.

The light emitted to the outside of the light quantity reinforcing lens body 41 is not simply diffused into the light distribution space S and does not go straight, but is condensed on the circumference of the light quantity reinforcing lens body 41 by the second light condensing and diverging part 43. Accordingly, it is possible to clearly implement a lighting image having a shape corresponding to the second light condensing and diverging part 43.

Referring to FIG. 2, FIG. 3, and FIG. 7, the half mirror 50 in accordance with an embodiment includes a half mirror body 51, a transflective reflection part 52, the spot prevention grooves 53, and contrast grooves 54.

The half mirror body 51 includes a light transmitting material and is disposed to cover one end of the light distribution space S. The half mirror body 51 has a plate shape capable of covering the front portion of the light distribution space S. The transflective reflection part 52 is a part that forms the half reflection surface F1, includes a material capable of reflecting light, and is formed on a rear surface of the half mirror body 51.

The half reflection surface F1 implements an optical action of allowing some of lights to pass therethrough and reflecting the rest of the lights to the mirror 60. The half reflection surface F1 is disposed to face the mirror reflection surface F2 of the mirror 60 in the front and rear direction. The lights diverged through the first light condensing and diverging part 33 are infinitely reflected in the front and rear direction between the half reflection surface F1 and the mirror reflection surface F2, and simultaneously, some of the lights are transmitted to the front. Thus, the lights are expressed in a continuous linear shape in which their widths and light intensities gradually decrease toward the rear when the lights are viewed by the naked eye.

Here, "the lights are expressed in a continuous linear shape in which their widths and light intensities gradually decrease" means that the lights are expressed as an image in which light widths and light intensities gradually decrease with a setting difference and as an image in which light widths and light intensities decrease continuously and smoothly, by adjusting the lengths of the light guide 20 and the divergence lens 30 in the x direction and the light quantity of the light source 11 (for example, LED).

The spot prevention groove 53 is a part that is assembled to the half mirror assembly part 34 of the divergence lens 30, and is formed at the edge of the half mirror body 51 in the form of a groove or a hole. The half mirror body 51 in accordance with an embodiment has a disc shape as a whole and the spot prevention groove 53 is disposed to form a sawtooth shape as a whole.

More specifically, the spot prevention groove 53 in accordance with an embodiment has a structure formed at the edge of the half mirror body 51 so as to be concave toward the central part of the half mirror body 51. The recessed depth of the spot prevention groove 53 is shorter than the length of the divergence lens 30 in the x axis radial direction. Accordingly, a part of the divergence lens 30 is covered and supported by the divergence lens cover portion 732 of the bezel 70 and the other part of the divergence lens 30 is covered and supported by the spot prevention groove 53 of the half mirror 50.

Since the light guide 20 and the divergence lens 30 are in contact with the divergence lens cover portion 732 of the bezel 70 and the spot prevention groove 53, the movements in the vertical direction and lateral direction of the light guide 20 and the divergence lens 30 is restricted. Since the light guide 20 and the divergence lens 30 are in contact with a design cover part 73 of the bezel 70 disposed at the front and the half mirror 50, the forward movements of the light guide 20 and the divergence lens 30 is restricted. Since the light guide 20 and the divergence lens 30 are in contact with a light source installation part 71 of the bezel 70 disposed at the rear and a substrate 12, the rearward movements of the light guide 20 and the divergence lens 30 is restricted.

The half mirror assembly part 34 of the divergence lens 30, particularly, an inner end of the first light condensing and diverging part 33 directed to the central part of the light distribution space S is fitted and assembled into the spot prevention groove 53 by passing through the half reflection surface F1 forward. At this time, the front end of the divergence lens 30 is disposed on the same yz plane as the front end of the half mirror body 51, and an inner end of the half mirror assembly part 34, where light is diverged, is covered and supported by the spot prevention groove 53.

When the front end of the divergence lens 30 and the half reflection surface F1 of the half mirror 50 are disposed to be in contact with each other or face each other, a plurality of light spots having a shape corresponding to the front end of the divergence lens 30, particularly, the corner of the divergence lens 30, at which light condensation is clear, may be formed throughout the half mirror 50.

By forming the spot prevention groove 53 and fitting and assembling the front end of the divergence lens 30 into the spot prevention groove 53 through the half reflection surface F1, it is possible to substantially prevent a phenomenon in which light spots are unintentionally formed on the half mirror 50. Accordingly, it is possible to more clearly and reliably implement a three-dimensional lighting image aimed by the embodiments described herein.

The contrast groove 54 is a part for implementing a contrast effect with the light diverged from the divergence lens 30, and is formed to be concave between the spot prevention grooves 53 toward the central part of the half mirror body 51. A contrast protruding portion 723 of the bezel 70 made of a non-light transmitting material is fitted and assembled into the contrast groove 54.

Referring to FIG. 1, FIG. 4, and FIG. 6, the bezel 70 in accordance with an embodiment includes the light source installation part 71, a lens installation part 72, and the design cover part 73. In a state in which the light source installation part 71, the lens installation part 72, and the design cover part 73 are connected to one another, the bezel 70 has a case shape in which a front part thereof is opened and the light distribution space S is formed therein. The size and shape of the bezel 70 correspond to the actual size and shape of the three-dimensional image lighting apparatus 1 in accordance with an embodiment.

The light source installation part 71 is a part of the bezel 70, in which the light sources 11 are installed, includes a non-light transmitting material, and constitutes the rear part of the bezel 70. The light source installation part 71 in accordance with an embodiment includes a first bezel body 711 and light transmitting hole portions 712.

The first bezel body 711 is a part that forms the basic frame of the light source installation part 71, has a plate or ring shape corresponding to the rear portion of the light distribution space S, and is disposed in front of the substrate 12 on which the light sources 11 are disposed. The light transmitting hole portion 712 is formed to pass through the first bezel body 711 in the front and rear direction, and forms a space capable of receiving the light source 11 or a path through which the light emitted from the light source 11 can pass.

The light transmitting hole portion 712 is formed at a position corresponding to each of the light sources 11 and the light guides 20, and the rear end of the light guide 20, that is, the first incident part 22 is disposed inside the light transmitting hole portion 712. Accordingly, the light emitted from the light source 11 can be stably incident into the light guide 20 without loss on the light transmitting hole portion 712.

In accordance with an embodiment, a plurality of light sources 11 are mounted on the front portion of the circular substrate 12. By coupling the substrate 12 and the first bezel body 711 to each other by a fastening member (not illustrated), the light source 11 can be fixed at a preset position on the light transmitting hole portion 712.

The lens installation part 72 is a part of the bezel 70, in which the light guide 20 and the divergence lens 30 are installed, includes a non-light transmitting material, and constitutes the circumference of the light distribution space S. The lens installation part 72 has a hollow tube or pipe shape and is disposed in front of the light source installation part 71.

The rear end of the lens installation part 72 is connected to the light source installation part 71 and the front end thereof is connected to the design cover part 73. The light guide 20 and the divergence lens 30 are disposed on the inner surface of the lens installation part 72, the inner surface being in contact with the light distribution space S. The lens installation part 72 in accordance with an embodiment includes a second bezel body 721, cover grooves 722, and the contrast protruding portions 723.

The second bezel body 721 is a part that forms the basic frame of the lens installation part 72, has a tube or pipe shape corresponding to the circumference of the light distribution space S, and is disposed in front of the light source installation part 71. The cover groove 722 is a part assembled to the light guide 20 and the divergence lens 30, and is recessed into the inner surface of the second bezel body 721, the inner surface being in contact with the light distribution space S.

A plurality of cover grooves 722 are formed to extend in the front and rear direction from the front end to the rear end of the second bezel body 721, and are disposed to be spaced apart from one another along the inner surface of the second bezel body 721. Inside the cover groove 722, the light guide 20 is received and the light diffusion incident part 32 of the divergence lens 30 is disposed.

The contrast protruding portion 723 protrudes between the cover grooves 722 toward the central part of the light distribution space S. The contrast protruding portions 723 are formed to extend in the front and rear direction from the front end to the rear end of the second bezel body 721. In a state in which the light guide 20 and the divergence lens 30 have been assembled to the cover groove 722, the divergence lens 30 and the contrast protruding portion 723 are alternately disposed along the inner surface of the light distribution space S.

The traveling in the circumferential direction of the lights diverged from the first light condensing and diverging parts 33 of the divergence lenses 30 is blocked by the contrast protruding portions 723. Accordingly, it is possible to more clearly express each of the linear lighting images extending in the front and rear direction, by the first light condensing and diverging parts 33 of the divergence lenses 30.

As described above, it is possible to implement the contrast effect by the difference in brightness between the lights diverged from the divergence lenses 30 and the contrast protruding portions 723, and to implement a lighting image having a shape in which the light emission lines formed by the divergence lenses 30 are disposed at set intervals along the circumference of the light distribution space S while each light emission line is clearly distinguished from adjacent other light emission lines. When the bezel 70 includes a black non-light emitting material, it is possible to further emphasize such a contrast effect.

The design cover part 73 is a part that covers the front ends of the light guides 20 and the divergence lenses 30 and the edge of the half mirror 50, and constitutes the front part of the bezel 70. The design cover part 73 is connected to the lens installation part 72 in front of the half mirror 50. The design cover part 73 in accordance with an embodiment includes a third bezel body 731, the divergence lens cover portions 732, and protruding bezel cover portions 733.

The third bezel body 731 has a ring shape capable of covering the front ends of the light guides 20 disposed along the light distribution space S. The first bezel body 711, the second bezel body 721, and the third bezel body 731 may be coupled to one another by a fastening member (not illustrated) and the like.

The divergence lens cover portion 732 is a part that covers the front end of the divergence lens 30, and protrudes from the inner surface of the third bezel body 731 in the x axis center direction. The divergence lens cover portions 732 in accordance with an embodiment is formed to have a width greater than the front end of the divergence lens 30 so as to serve as a locking protrusion for restricting the forward movement of the half mirror 50 while covering the spot prevention groove 53 that covers the front end of the divergence lens 30.

The protruding bezel cover portion 733 is a part that covers the front ends of the contrast protruding portions 723, and is alternately disposed with the divergence lens cover portions 732 along the inner surface of the third bezel body 731. The protruding bezel cover portion 733 in accordance with an embodiment is formed to have a width greater than the front end of the contrast protruding portion 723 so as to serve as a locking protrusion for restricting the forward movement of the half mirror 50 while covering the contrast groove 54 that covers the front end of the contrast protruding portion 723.

The light source installation part 71, the lens installation part 72, and the design cover part 73 in accordance with an embodiment have a structure in which they are separately manufactured and assembled and coupled to one another; however, this is for disclosing a preferred example and is not intended to limit the embodiments described herein. Since the light source installation part 71, the lens installation part 72, and the design cover part 73 are classified and named according to the functions thereof, it may be possible to implement various other embodiments such as an embodiment in which the light source installation part 71 and the lens installation part 72 are integrally formed or the lens installation part 72 and the design cover part 73 are integrally formed.

According to the three-dimensional image lighting apparatus 1 in accordance with an embodiment, which has the aforementioned configuration, it is possible to implement a linear lighting image extending in the front and rear direction by using the light guides 20 and the divergence lenses 30, and to express the image in a seamless linear shape in which the width and light intensity thereof gradually and continuously decrease toward the rear by infinite reflection between the half mirror 50 and the mirror 60.

Consequently, in accordance with an embodiment, it is possible to express a three-dimensional lighting image having an infinite sense of depth in the front and rear direction by the optical action described above, and when the plurality of divergence lenses 30 are disposed along the circumference of the light distribution space S, it is possible to implement a tunnel-shaped lighting image surrounded by a plurality of light emission lines, thereby more dramatically expressing a sense of depth in the front and rear direction.

Furthermore, in accordance with an embodiment, as a linear lighting image continuously extending in the front and rear direction is implemented, it is possible to implement a new lamp design clearly differentiated from an existing infinite reflection lighting image expressed in shape in which spot or ring-shaped lights are stacked while being spaced apart from one another in the front and rear direction.

Furthermore, in accordance with an embodiment, since a three-dimensional lighting image having an infinite sense of depth longer than an actual size can be implemented as a vehicle lamp design. Thus, when the three-dimensional lighting image is applied to a component such as a headlamp and a rear lamp of a vehicle, it is possible to further improve the degree of freedom of the vehicle lamp design.

Furthermore, the embodiments described herein have a simple structure including the light guides 20, the divergence lenses 30, the half mirror 50, and the mirror 60. Thus, when an embodiment is applied to a component such as a headlamp and a rear lamp of a vehicle, it is possible to further reduce the number of parts as compared with an existing infinite reflection type vehicle lamp, thereby further facilitating the manufacture, management, and assembly of vehicle lamp components.

So far, the present invention has been described with reference to the embodiments. Those skilled in the art in the technical field to which the embodiments described herein pertain will be able to understand that the embodiments described herein may be implemented in a modified form without departing from the essential characteristics thereof. Therefore, the embodiments should be considered from an explanatory point of view rather than a limitative point of view. The scope of the present invention is disclosed in the claims rather than the aforementioned description, and all differences within the equivalent range thereof should be construed as being included in the present invention.

What is claimed is:

1. A three-dimensional image lighting apparatus comprising:

one or more light guides configured to guide paths of lights incident from one or more light sources toward a light distribution space, and to emit the lights;

one or more divergence lenses disposed on the light distribution space so as to extend along the one or more light guides, and configured to diverge the lights, which are incident from the one or more light guides, in a linear shape;

a half mirror disposed on one side of the one or more divergence lenses; and a mirror disposed on the other side of the one or more divergence lenses so as to face the one or more divergence lenses, and configured to reflect the lights, which are diverged by the one or more divergence lenses, between the half mirror and the mirror, wherein each of the one or more divergence lenses has a linear rod shape and is disposed spaced apart from one another along a circumference of the light distribution space, and the one or more light guides each has a linear rod shape and is disposed to correspond to the one or more divergence lenses, respectively.

2. The three-dimensional image lighting apparatus according to claim 1, wherein each of the one or more light guides comprises:

a light guide body;

a first incident part formed on one end of the light guide body in an extension direction thereof and into which the lights emitted from the one or more light sources is incident;

an inward emission part formed on one side of a circumferential portion of the light guide body, the one side facing the one or more divergence lens, and configured to emit the light to an outside of the light guide body; and a total reflection part formed on the other side of the circumferential portion of the light guide body, the other side being toward an outside of the light distribution space, and configured to totally reflect the light toward the inward emission part.

3. The three-dimensional image lighting apparatus according to claim 1, wherein each of the one or more divergence lens comprises:

a divergence lens body; and a light diffusion incident part which is formed on one side of a circumferential portion of the divergence lens body, the one side facing the light guide, into which the lights emitted from the one or more light guides is incident, and which has an uneven shape capable of diffusing the incident light.

4. The three-dimensional image lighting apparatus according to claim 1, wherein each of the one or more divergence lens comprises:

a divergence lens body; and a first light condensing and diverging part formed on the other side of a circumferential portion of the divergence lens body, the other side being in contact with the light distribution space and having a surface shape capable of inducing condensation of the light emitted to an outside of the divergence lens body.

5. The three-dimensional image lighting apparatus according to claim 1, further comprising:

one or more light quantity reinforcing lenses disposed at a central part of the light distribution space so as to be spaced apart from the one or more divergence lenses, and configured to diverge the lights incident from the one or more light sources toward the light distribution space.

6. The three-dimensional image lighting apparatus according to claim 5, wherein each of the one or more light quantity reinforcing lens comprises:

a light quantity reinforcing lens body;

a second incident part formed on one end of the light quantity reinforcing lens body in an extension direction thereof and into which the lights emitted from the one or more light sources are incident; and a second light condensing and diverging part formed on a circumference of the light quantity reinforcing lens body and having a surface shape capable of inducing condensation of the light emitted to an outside of the light quantity reinforcing lens body.

7. A three-dimensional image lighting apparatus comprising:

one or more light guides configured to guide paths of lights incident from one or more light sources toward a light distribution space, and to emit the lights;

one or more divergence lenses disposed on the light distribution space so as to extend along the one or more light guides, and configured to diverge the lights, which are incident from the one or more light guides, in a linear shape;

a half mirror disposed on one side of the one or more divergence lenses; and a mirror disposed on the other side of the one or more divergence lenses so as to face the one or more divergence lenses, and configured to reflect the lights, which are diverged by the one or more divergence lenses, between the half mirror and the mirror, wherein the half mirror comprises:

a half mirror body including a light transmitting material and configured to cover one end of the light distribution space;

a transflective reflection part including a material capable of reflecting light, formed on one surface of the half mirror body, and configured form a half reflection surface that allows a first portion of the one or more lights to pass therethrough and reflects a remaining portion of the one or more lights to the mirror; and one or more spot prevention grooves formed at an edge of the half mirror body, and into which some or all of circumferential portions of the one or more divergence lenses, which face the light distribution space, are fitted and covered.

8. The three-dimensional image lighting apparatus according to claim 7, wherein each of the one or more divergence lens comprises:

a divergence lens body;

half mirror assembly parts formed on one end of the divergence lens body in an extension direction thereof and fitted into the spot prevention grooves by passing through the half reflection surface; and mirror assembly parts formed on the other end of the divergence lens body in an extension direction thereof and assembled to the mirror.

9. The three-dimensional image lighting apparatus according to claim 7, wherein the spot prevention groove is formed at an edge of the half mirror body so as to be concave toward a central part of the half mirror body, and one end of the divergence lens is fitted into the spot prevention groove by passing through the half reflection surface.

10. The three-dimensional image lighting apparatus according to claim 7, wherein the half mirror further comprises:

one or more contrast grooves formed to be concave among the spot prevention grooves toward a central part of the half mirror body and into which non-light transmitting materials, in which light diverged from the one or more divergence lens and contrast are distinguished, are fitted.

11. The three-dimensional image lighting apparatus according to claim 1, further comprising:

a bezel including a non-light transmitting material and configured to form the light distribution space by having the one or more light guides, the one or more divergence lenses, the half mirror, and the mirror situated thereon.

12. The three-dimensional image lighting apparatus according to claim 11, wherein the bezel comprises:

a light source installation part in which the one or more light sources are installed;

a lens installation part connected to the light source installation part and having an inner surface on which the one or more light guides and the one or more divergence lenses are disposed, the inner surface being in contact with the light distribution space; and a design cover part connected to the lens installation part and configured to cover ends of the one or more light guides and the one or more divergence lenses being in contact with the half mirror.

13. The three-dimensional image lighting apparatus according to claim 12, wherein the light source installation part comprises:

a first bezel body; and one or more light transmitting hole portions formed to pass through the first bezel body, and configured form a space capable of receiving the one or more light sources or paths through which the lights emitted from the one or more light sources are able to pass, and having the ends of the one or more light guides disposed therein.

14. The three-dimensional image lighting apparatus according to claim 12, wherein the lens installation part comprises:

a second bezel body; and one or more cover grooves recessed into an inner surface of the second bezel body, the inner surface being in contact with the light distribution space, configured to receive the one or more light guides therein, and having some of the one or more divergence lenses disposed therein.

15. The three-dimensional image lighting apparatus according to claim 14, wherein the lens installation part further comprises:

one or more contrast protruding portions protruding among the one or more cover grooves, interleavedly disposed with the divergence lenses, and configured to implement a contrast effect by a difference in brightness from the one or more lights diverged from the one or more divergence lenses.

16. The three-dimensional image lighting apparatus according to claim 12, wherein the design cover part comprises:

a third bezel body having a ring shape of covering one end of the one or more light guides in an extension direction thereof; and one or more divergence lens cover portions protruding from an inner surface of the third bezel body and configured to cover one end of the one or more divergence lenses in an extension direction thereof.

17. The three-dimensional image lighting apparatus according to claim 16, wherein the lens installation part comprises:

a second bezel body;

one or more cover grooves recessed into an inner surface of the second bezel body, the inner surface being in contact with the light distribution space, configured to receive the one or more light guides therein, and having some of the one or more divergence lenses disposed therein; and one or more contrast protruding portions protruding among the cover grooves, interleavedly disposed with the one or more divergence lenses, and configured to implement a contrast effect by a difference in brightness from the lights diverged from the one or more divergence lenses, wherein the design cover part further comprises:

one or more protruding bezel cover portions alternately disposed with the divergence lens cover portions along an inner surface of the third bezel body and configured to cover one end of the one or more contrast protruding portions in an extension direction thereof.

18. A three-dimensional image lighting apparatus comprising:

a light guide configured to guide a path of light incident from a light source toward a light distribution space, and to emit the light;

a divergence lens disposed on the light distribution space so as to extend along the light guide, and configured to diverge the light, which is incident from the light guide, in a linear shape;

a half mirror disposed on one side of the divergence lens; and a mirror disposed on the other side of the divergence lenses so as to face the divergence lens, and configured to reflect the light, which is diverged by the divergence lens, between the half mirror and the mirror, wherein the divergence lens has a linear rod shape and is disposed spaced apart from another divergence lens along a circumference of the light distribution space, and the light guides has a linear rod shape and is disposed to correspond to the divergence lens.

19. The three-dimensional image lighting apparatus according to claim 18, wherein the three-dimensional image lighting apparatus is disposed in a headlight of a vehicle.

* * * * *